United States Patent [19]

Oberg

[11] 3,965,812

[45] June 29, 1976

[54] METHOD OF COMPRESSING SCRAP METAL

[76] Inventor: Gordon D. Oberg, 20509 Crawford Road, Lynwood, Wash. 98036

[22] Filed: Sept. 24, 1974

[21] Appl. No.: 508,830

[52] U.S. Cl. ..... 100/39; 83/623; 100/DIG. 1; 100/42; 100/98 R; 100/100; 100/215; 100/218; 100/232; 100/233; 100/249; 100/269 R; 100/264

[51] Int. Cl.[2] ..... B30B 9/32

[58] Field of Search ..... 100/39, 98 R, 232, 100, 100/218, 249, 269 R, 233, 215, 137, 138, 139, 140, 42, DIG. 1, 264; 83/623

[56] References Cited

UNITED STATES PATENTS

| | | | |
|---|---|---|---|
| 1,822,923 | 9/1931 | Duerr | 100/215 X |
| 1,879,356 | 9/1932 | Lindemann | 100/215 |
| 3,005,403 | 10/1961 | Van Endert | 100/98 R |
| 3,039,343 | 6/1962 | Richards | 100/DIG. 1 |
| 3,089,410 | 5/1963 | Stagl | 100/215 |
| 3,149,428 | 9/1964 | Hukill | 100/232 |
| 3,157,082 | 11/1964 | Thompson | 100/215 X |
| 3,170,389 | 2/1965 | Parks | 100/DIG. 1 |
| 3,545,369 | 12/1970 | Tokushima | 100/98 R |
| 3,554,119 | 1/1971 | Schoellhorn et al. | 100/215 |
| 3,752,064 | 8/1973 | Suzuki | 100/98 R |

*Primary Examiner*—Billy J. Wilhite
*Attorney, Agent, or Firm*—Thomas W. Secrest

[57] ABSTRACT

This invention is directed to an apparatus and method wherein relatively large bulky pieces of scrap metal can be, substantially, simultaneously, divided or separated into smaller pieces of scrap metal and then compressed into smaller and more dense units of scrap metal. In compressing the bulky scrap metal into smaller and more dense units of scrap metal, the grade and quality of the scrap metal is increased so as to be more, economically, valuable.

3 Claims, 20 Drawing Figures

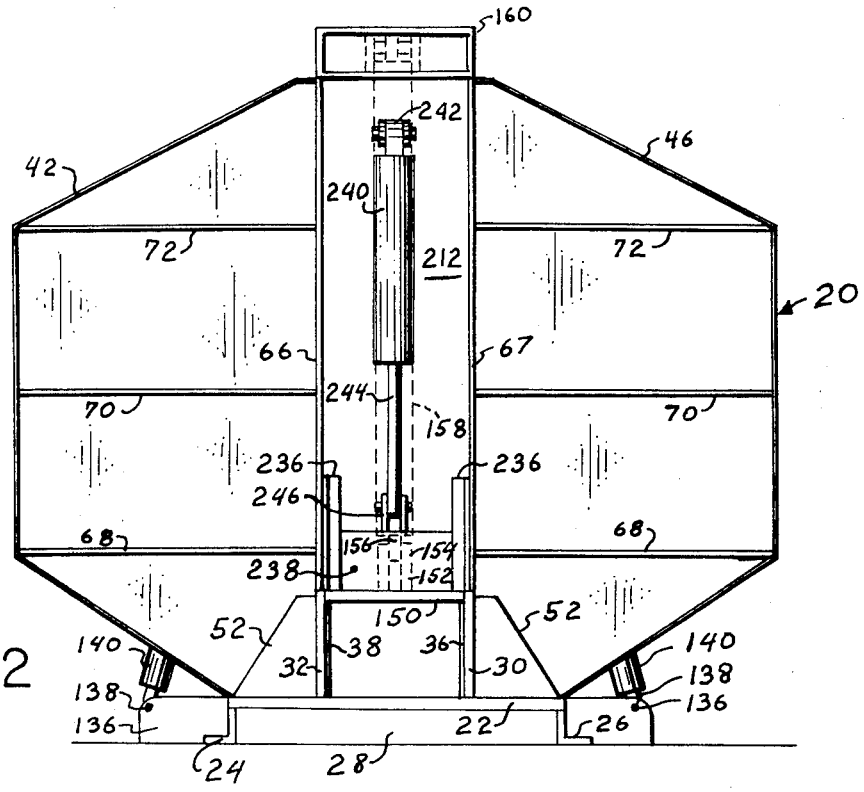
FIG. 2
FIG. 3
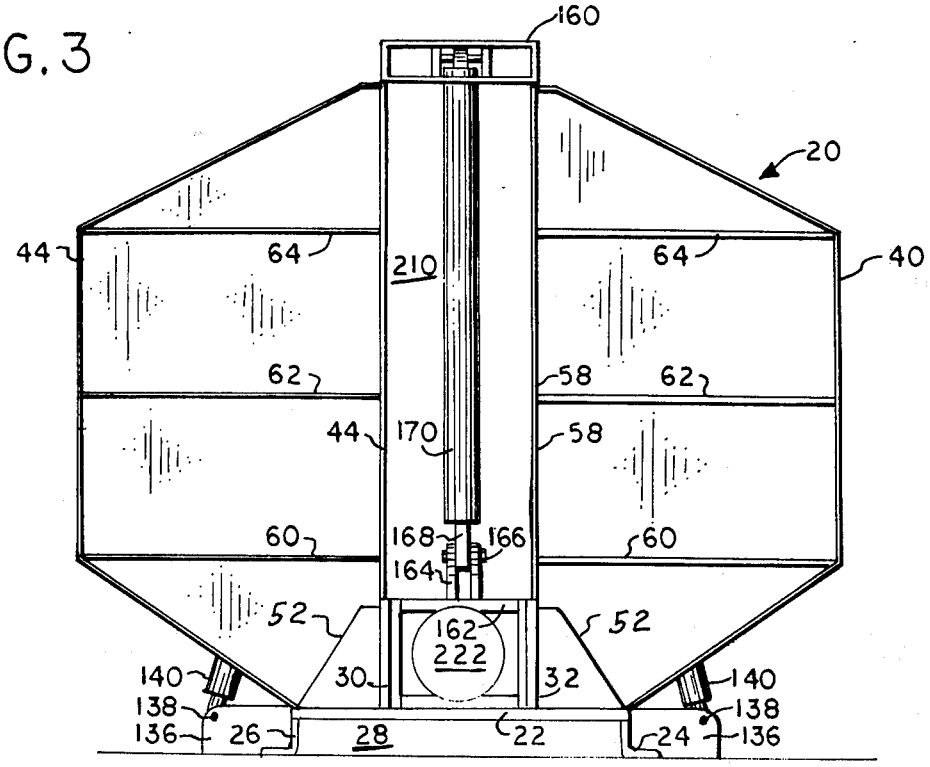

METHOD OF COMPRESSING SCRAP METAL

THE BACKGROUND OF THE INVENTION

In our society, as a side effect, there is produced considerable scrap metal. For example, there are automotive vehicles which are no longer useful or which have been abandoned. These automotive vehicles such as automobiles and trucks must be processed as the storage of these vehicles creates a problem and becomes a blight on the countryside and these vehicles are, generally, unattractive after they have been abandoned or damaged. A further class of equipment is abandoned farm machinery. With the technological changes in farm machinery and improvements in farm machinery, the old farm machinery becomes obsolete and inadequate and is discarded. The discarded farm machinery is not used and after awhile becomes a blight on the countryside and should be removed. A further example is light industrial equipment which, after having served its useful purpose, is no longer adequate and is discarded. This light industrial equipment should be removed so as not to clutter the countryside, also to assist in making the countryside more beautiful. An example of this is construction equipment used in road building and also machinery used in manufacturing.

Generally, the automotive vehicles, farm machinery, light industrial equipment and the like is bulky for the weight. It is not economical to process and transport the bulky items as the items are too light to be economically transported. It is too expensive to physically handle these bulky items. Therefore, it is desirable to decrease the bulk of these items so that more items can be handled and processed in an economical manner. One way of handling bulky automotive vehicles and also bulky farm machinery is to smash the bulky items into more compact items. For example, in a wrecking yard, there may be used a relatively simple piece of equipment for smashing automobile bodies. There may be pivoted a heavy sledge having concrete as a filler and a weight. A cable may be attached to this heavy sledge. An automobile may be attached to the cable and upon moving the automobile the heavy sledge may be rotated upwardly. The bulky piece of equipment such as an old automobile body or a piece of farm machinery may be placed under the sledge and the sledge allowed to rotate and fall on the bulky scrap metal. The bulky scrap metal is compressed to a more dense unit of scrap metal which can be, economically, transported for further processing.

Another way of processing scrap metal is to shear the scrap metal into small pieces weighing less than a pound, to increase the bulk density, then collect these small pieces and transport to a steel mill or a further processing facility. The small pieces may be collected, loose, in a container and transported loose. As can be, readily, appreciated the density of the small pieces is, considerably, greater than the bulk density of the scrap metal such as an automotive vehicle body. There may be a portable shear for shearing the automotive vehicle body into small pieces of scrap metal.

Another way of handling the scrap metal is to shear the scrap metal into small pieces of less than about 10 pounds. Then these pieces of scrap metal can be compacted and compressed and baled and shipped in a bale. This increases the bulk density and makes it, economically feasible, to transport the scrap metal to a steel mill.

A further way of processing scrap metal is to shear the scrap metal into small pieces. Then, the small pieces can be separated into non-metallic material, magnetic metal and non-magnetic metal. For example, pieces of glass can be separated from the metal. The magnetic metal can be separated from the non-magnetic metal such as aluminum. The non-magnetic metal can be compressed into a unit of greater bulk density and shipped to further processing facility. The magnetic metal can be compressed into a unit of greater bulk density and shipped to a steel mill or further processing facility.

A further way of processing scrap metal of small bulk density but of relatively large volume is to compress the scrap metal so as to increase the bulk density and also to, possibly, form long strips. Then, the long strips can be sheared into slugs or short pieces of scrap metal. The short pieces of scrap metal or slugs can be placed into a container and transported to a steel mill or further processing facility.

There are many ways of handling scrap metal. Generally, the purpose is to increase the bulk density so as to make it economical to transport the scrap metal, relatively, long distances. To increase the bulk density it may be necessary to shear off small pieces of scrap metal and to transport the sheared scrap metal in boxes or containers. In certain instances the sheared scrap metal can be compressed and compacted and baled.

THE GENERAL DESCRIPTION OF THE INVENTION

This invention comprises the method of processing scrap metal.

The method comprises the formation of a compressed mass of scrap metal to increase the bulk density to make it more economical to transport the scrap metal to a steel mill or a further processing facility. In carrying out the method, a relatively long piece of scrap metal such as a body of an automotive vehicle is positioned so as to, substantially, simultaneously, separate or shear away a portion of the body and to compress the body into a mass of scrap metal of high bulk density and greater economic value. Then, remaining portion or portions of the automotive vehicle can be compressed into a mass of greater bulk density.

The apparaus comprises a tunnel and a shear head which forces scrap metal into the tunnnel. The shear head upon forcing the scrap metal into the tunnel also compresses the scrap metal into a unit mass of greater bulk density than the scrap metal in the frame of an automobile.

On each side of the tunnel there is a rotatable support. The frame or the automobile can be positioned so part of the frame is over a first rotatable support, the central portion of the frame of the automobile is over the tunnel, and the other part of the frame is over the second rotatable support.

The shear head can move so as to separate the middle portion of the automobile frame from those portions over the rotatable supports. After the middle portion of the automobile frame has been removed by the shear head, the shear head can be moved away from the tunnel and one of the rotatable supports rotated to let the automobile frame fall into the tunnel. Then, the shear head can be moved to as to compress the automobile frame in the tunnel. Then, the shear head is removed and the second rotatable support rotated so as to let the rest of the automobile fall into the tunnel. The shear head can be removed to compress the automobile frame. There is a means for removing the compressed scrap metal or compressed automobile frame from the tunnel.

THE OBJECTS AND ADVANTAGES

The principal object and advantage of this invention is the provision of the apparatus having, relatively, few moving parts whereby scrap metal can be, if necessary, sheared into smaller, separate pieces and then compressed; another object is to provide such an apparatus whereby bulky scrap metal can be reduced to a small, compact mass; an additional object is to provide such an apparatus whereby it is possible to transport a large weight of metal in a, relatively, small volume thereby making it economically practical to transport scrap metal; a further object is to provide such an apparatus whereby scrap metal can be compressed to make a small, compact mass which is easy move and to handle; an additional object is to provide such an apparatus which is of straight forward design and construction with relatively few moving parts and requiring a minimum of maintenance; a further object is to provide such an apparatus which can be operated by one operator; another object is to provide such apparatus comprisng a combination shear and compactor for, substantially, simultaneously, shearing and compacting (compressing) scrap metal into bales; another object is to provide such an apparatus whereby operation of converting bulky scrap metal into a compact mass of scrap metal is inexpensive; and, another important object is to provide a method for converting a low density bulk scrap metal into a high density, small volume bale or block of scrap metal.

These and other important objects and advantages of the invention will be more particularly brought forth upon reference to the detailed description of the invention, the appended claims, and the accompanying drawings.

IN THE DRAWINGS

FIG. 2 is an end elevational view of the apparatus and illustrates the outlet end of the tunnel and a movable stop for controlling the movement of scrap metal in the tunnel;

FIG. 3 is an end elevational view of the apparatus and illustrates the means for compressing the scrap metal in the tunnel and also illustrates means to assist in raising the shear head;

Figure 4:
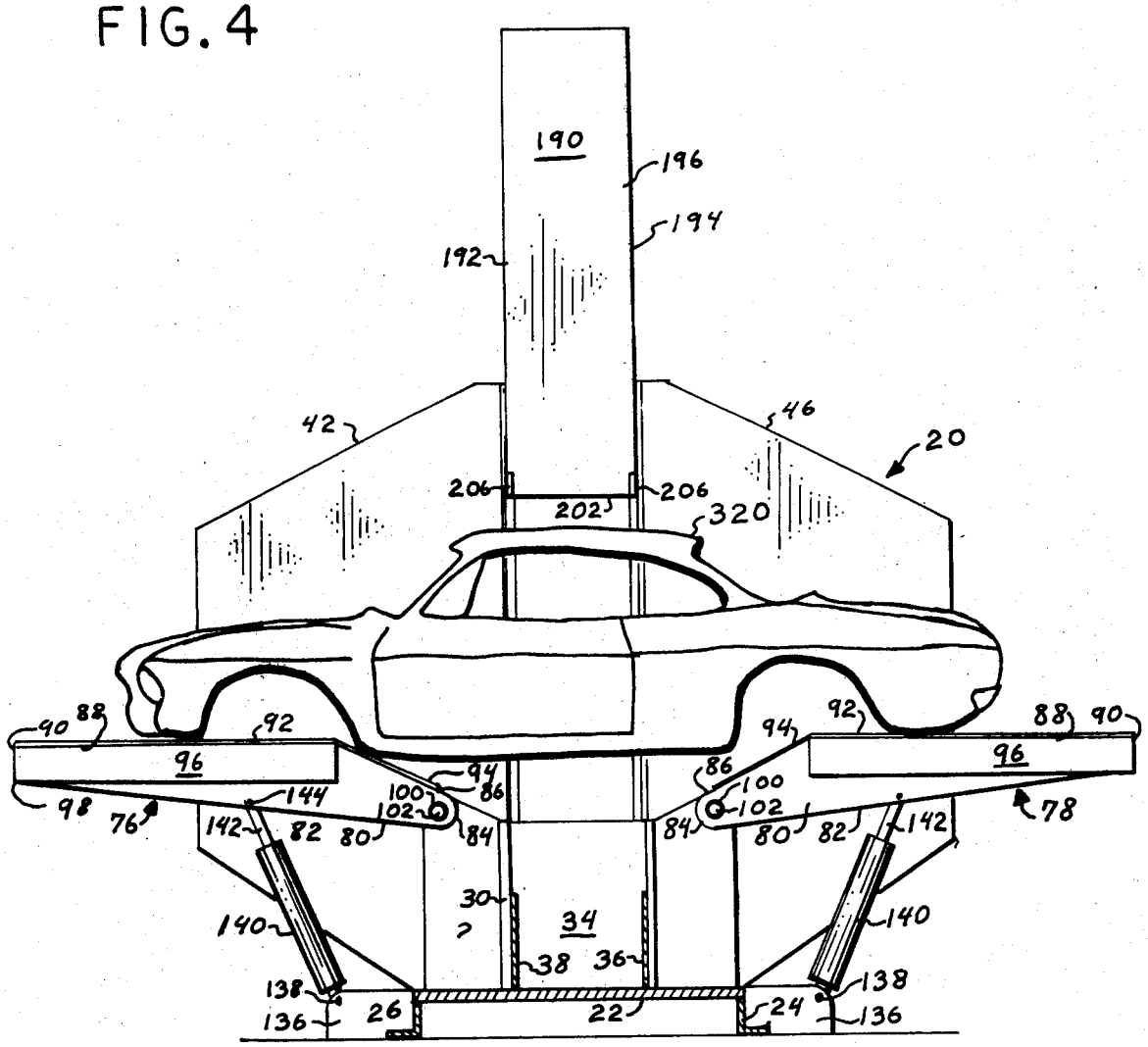
Figure 5:
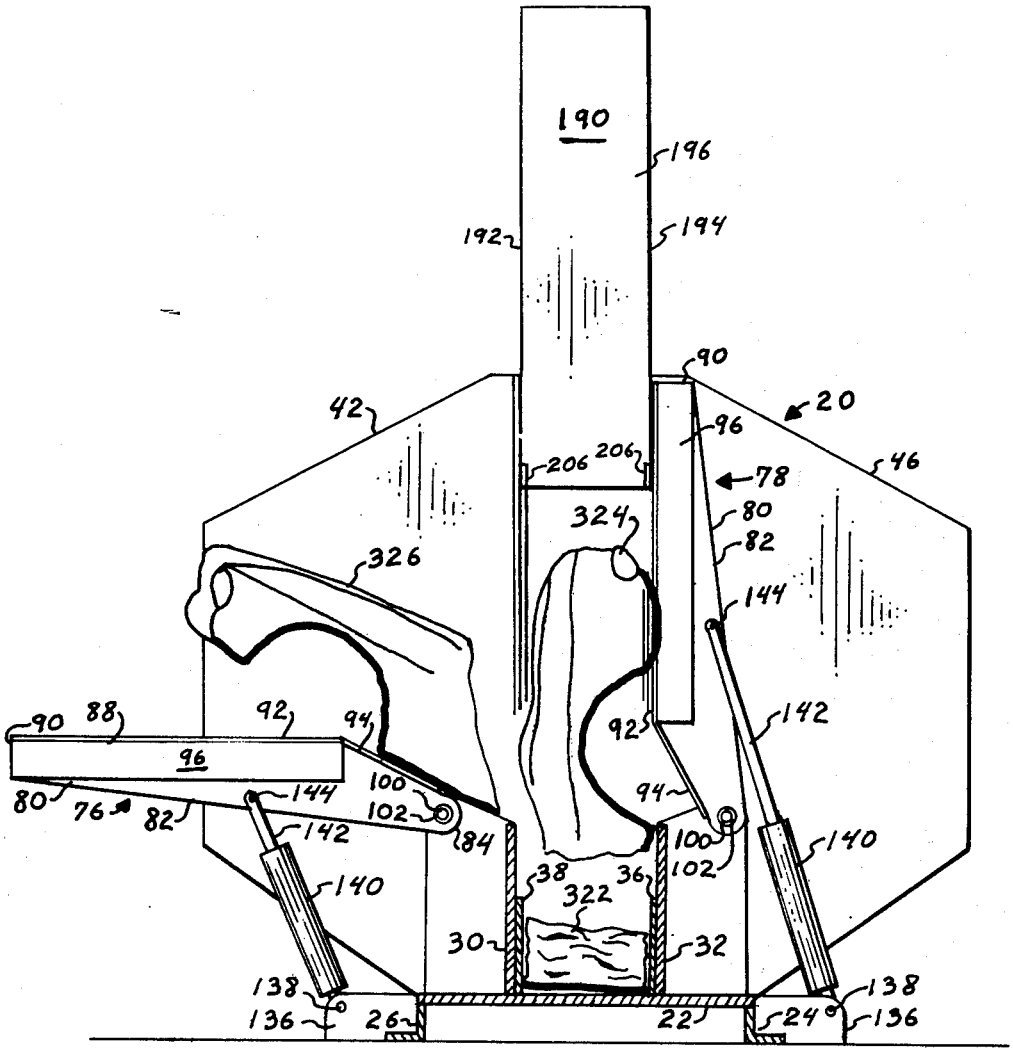
Figure 6:
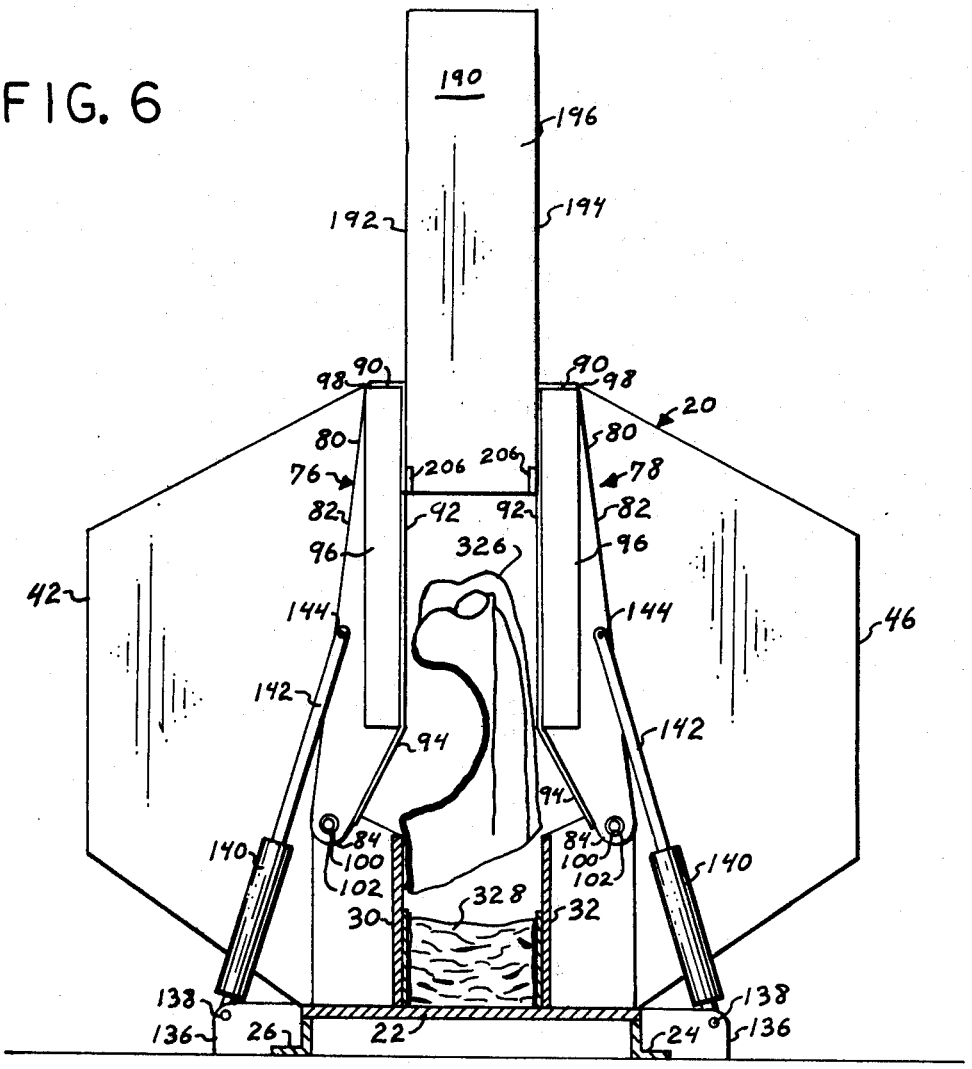
Figure 7:
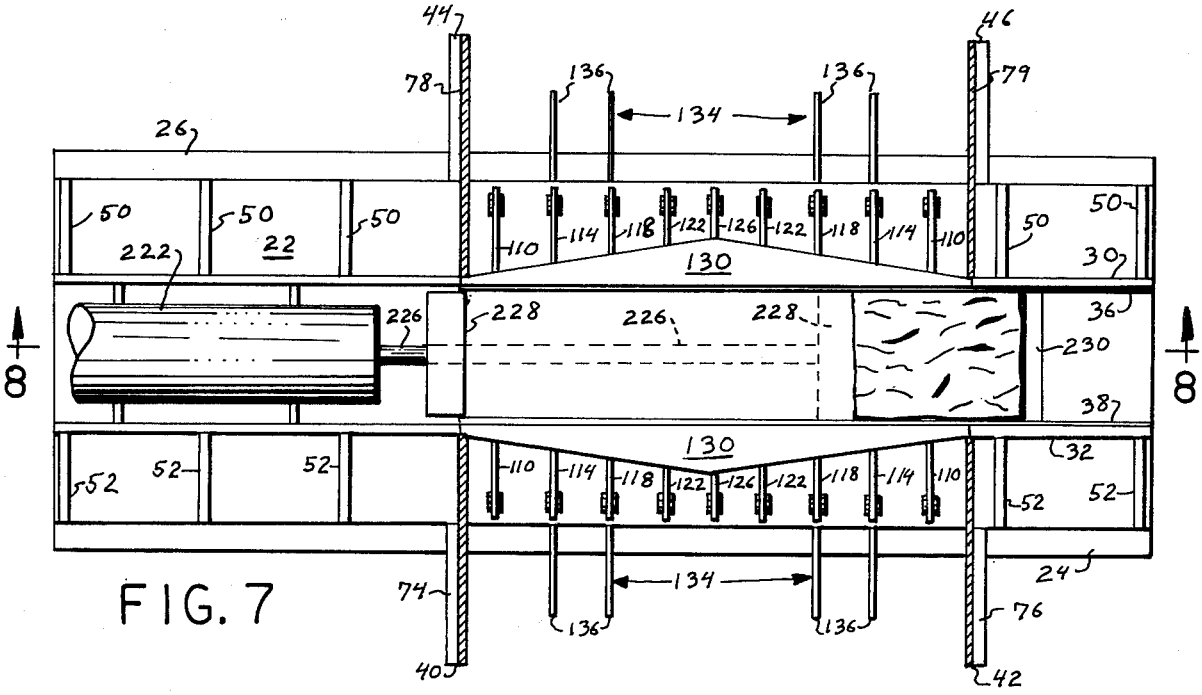
Figure 8:
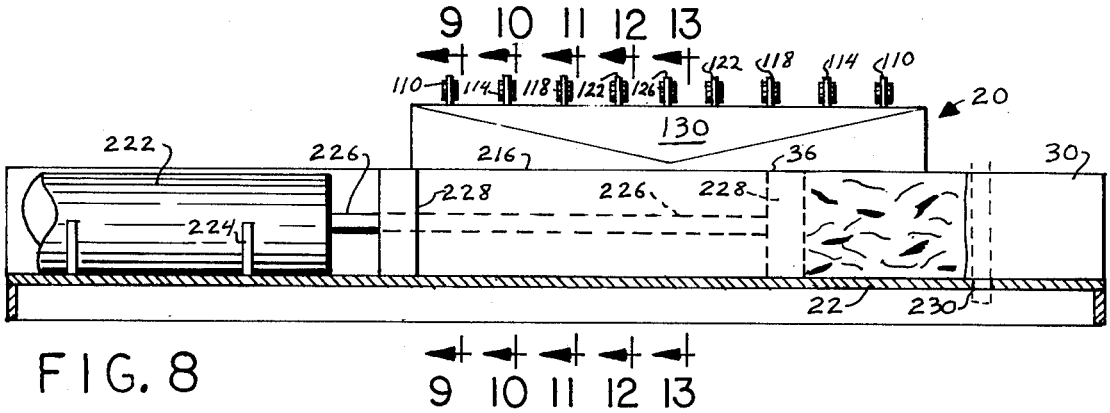
Figure 9:
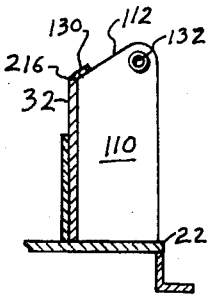
Figure 10:
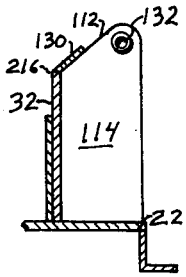
Figure 11:
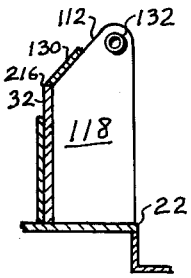
Figure 12:
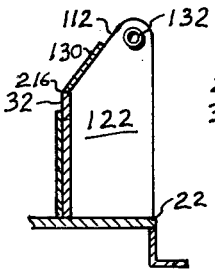
Figure 13:
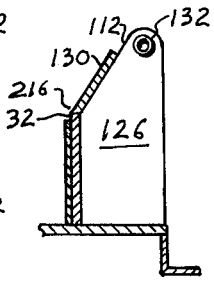
Figure 14:
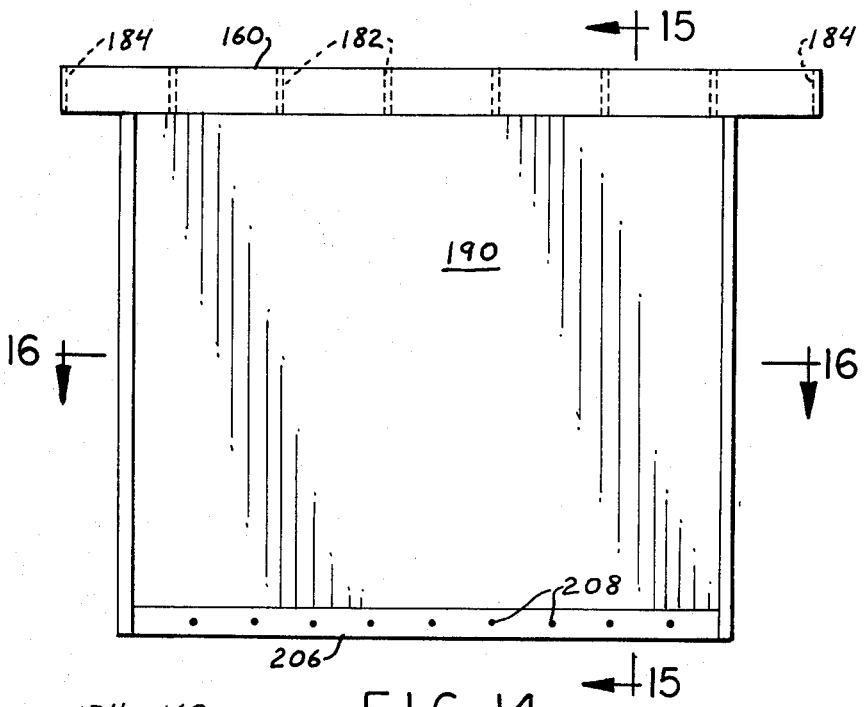
Figure 15:
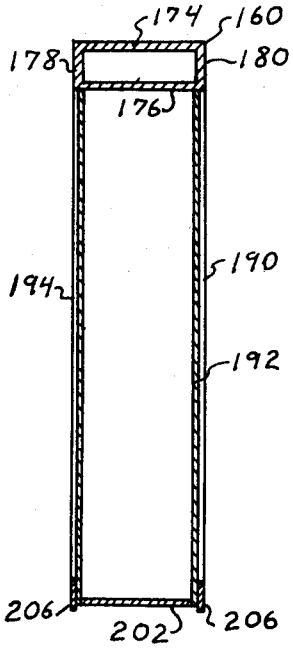
Figure 16:
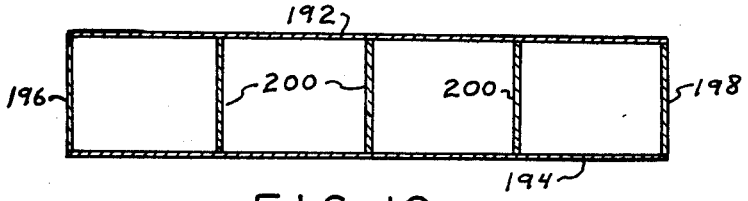
Figure 17:
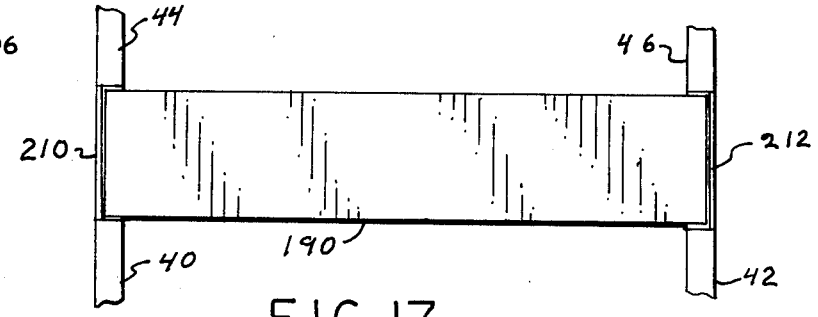
Figure 18:
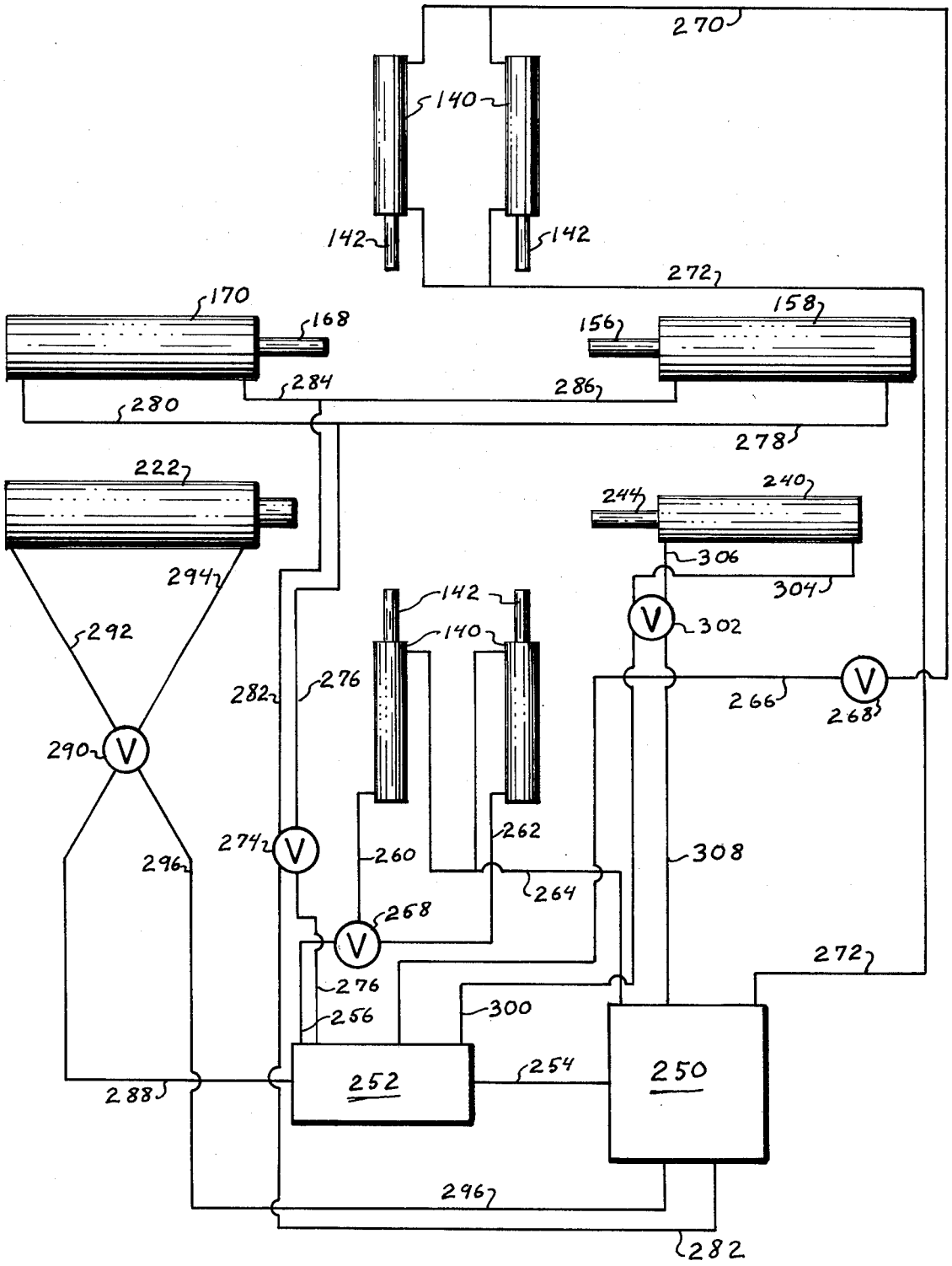
Figures 19, 20:
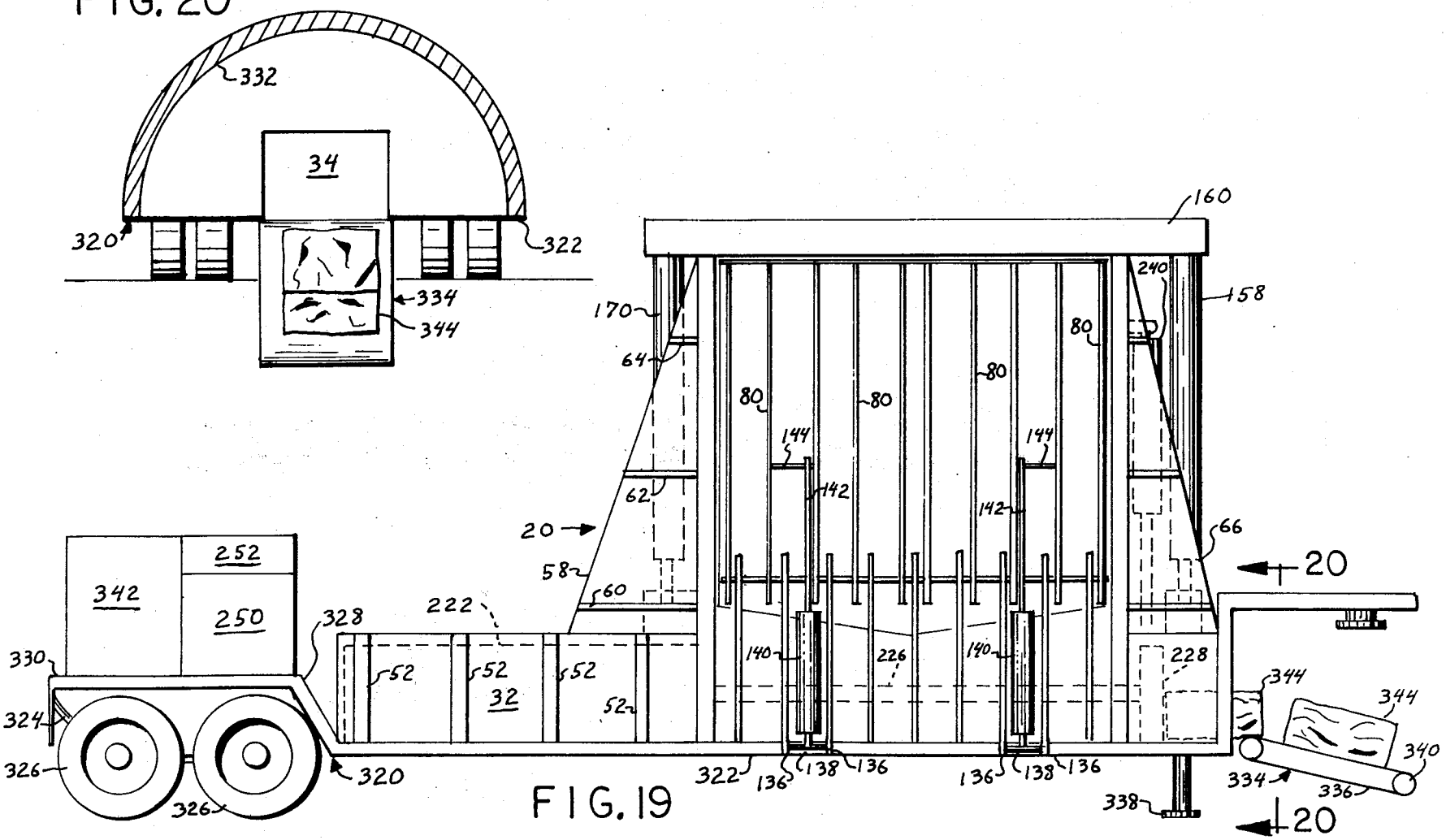

FIG. 4 is a fragmentary, lateral, vertical cross-sectional view of the apparatus and illustrates the tunnel, the rotatable sides on each side of said tunnel, the shear head in an elevated position and scrap metal, such as a body of automotive vehicle, positioned over the tunnel and supported by said rotatable sides, preparatory to the shear head being lowered and shearing the central portion of the body of the automotive vehicle away from the ends of the automotive vehicle;

FIG. 5 is a fragmentary, lateral, vertical cross-sectional view of the apparatus and illustrates the two ends of the automotive vehicle, after the central portion has been sheared away from said two ends and with the right rotatable side elevated so that one end of the automotive vehicle is positioned above the tunnel and wth the left rotatable side in a substantially, horizontal position, supporting the other end of the automotive vehicle, and with the shear head elevated preparatory to the shear head being lowered to compress and, possibly, shear that end of the automotive vehicle over said tunnel;

FIG. 6 is a fragmentary, lateral, vertical cross-sectional view of said apparatus and illustrates both of the rotatable sides in an elevated position and with the remaining end of the automotive vehicle positioned over said tunnel and with the shear head in an elevated position preparatory to being lowered so as to compress and compact and, possibly, shear said remaining end of the automotive vehicle in the tunnel;

FIG. 7 is a fragmentary, horizontal, longitudinal cross-sectional view of parts of the apparatus and with the rotatable sides and shear head removed so as to more, explicitly, illustrate the tunnel, a support for a stop means in the tunnel, and the means for compressing the scrap metal in the tunnel;

FIG. 8, taken on line 8—8 of FIG. 7, is a fragmentary, longitudinal, vertical, cross-sectional view illustrating the bottom support in said tunnel, a side wall of said tunnel, bearing means for supporting and allowing said rotatable side to rotate, an opening in the bottom support near the outlet end of said tunnel for receiving a stop means, and ram for compressing the scrap metal in said tunnel;

FIG. 9, taken on line 9—9 of FIG. 8, is a fragmentary, lateral, vertical, cross-sectional view illustrating the details of a support and a bearing for a rotatable side;

FIG. 10, taken on line 10—10 of FIG. 8, is a fragmentary, lateral, vertical, cross-sectional view illustrating the details of a second support and bearing for said rotatable side;

FIG. 11, taken on line 11—11 of FIG. 8, is a fragmentary, lateral, vertical, cross-sectional view illustrating the details of another support and bearing for said rotatable side;

FIG. 12, taken on line 12—12 of FIG. 8, is a fragmentary, lateral, vertical, cross-sectonal view illustrating the details of construction of another support and bearing for said rotatable side;

FIG. 13, taken on line 13—13 of FIG. 8, is a fragmentary, lateral, vertical, cross-sectonal view illustrating the details of construction of another support and bearing for said rotatable side;

FIG. 14 is a side-elevational view of the cross head and the depending shear head and the cutting edge on the lower edge of the shear head;

FIG. 15 is a vertical, lateral cross-sectional view taken on line 15—15 of FIG. 14 and illustrates details of construction of the shear head and cross head;

FIG. 16, taken on line 16—16 of FIG. 14, is a horizontal, lateral, cross-sectional view illustrating details of construction of the shear head and the bracing members;

FIG. 17 is a fragmentary, plan view illustrating the shear head, the upright guides and the plate connecting the upright guides, and which upright guides and plate function as guides for the up and down movement of the shear heads;

FIG. 18 is a schematic view of illustrating the fluid actuating system for operating the fluid actuated cylinders and rams for raising and lowering the shear head, for raising and lowering the rotatable sides, for raising and lowering the stop on the exit end of the tunnel and for moving the plunger in the tunnel;

FIG. 19 is a side elevational view illustrating the apparatus 20 mounted on a trailer for portability and making it possible to transport the shearing and compressing apparatus to various sites to reduce bulky scrap metal, such as refrigerators, washing machines, dryers, stoves and the like, into compact, high density small volume bales of scrap metal; and, FIG. 20, taken on line 20—20 of FIG. 19, is a vertical lateral cross-sectional view illustrating the outlet tunnel and conveying means for conveying small high density compact bales of scrap metal out of the apparatus.

THE SPECIFIC DESCRIPTION OF THE INVENTION

In the drawings it is seen that there is an apparatus 20 for shearing scrap metal and compressing the sheared scrap metal.

The apparatus 20 comprises a base having a bottom support 22 and on the ends of the bottom support there are downwardly directed legs 24 and outwardly directed foot 26. In effect, the legs 24 and foot 26 may be an angle iron. Positioned underneath the bottom support 22 and connecting with the opposite legs 24 are lateral braces 28 to add support to the bottom support 22 and also to add rigidity to the legs 24. The lateral braces 28 may be spaced approximately every foot or foot and a half.

There is positioned on the bottom support 22 two upright side walls, viz., a first side wall 30 and a second side wall 32. The side walls 30 and 32 are spaced apart.

It is seen that the bottom support 22, the first side wall 30 and the second side wall 32 define a tunnel 34.

On the inside face of the first side wall 30, there is reinforcing plate 36 and on the inside face of the second side wall 32, there is a reinforcing plate 38. The reinforcing plate 36 or scuffing plate 36 may be welded to the first side wall 30 and the reinforcing plate 38 or scuffing plate 38 may be welded to the second side wall 32.

The side walls 30 and 32 are substantially parallel and are also, substantially at right angles to the bottom support 22.

In FIG. 7, it is seen that there are two spaced apart upright guides 40 and 42 attached to the side wall 30 and also to the bottom support 22.

Further, there are two upright, spaced apart guides 44 and 46 attached to the side wall 32 and to the bottom support 22.

The upright guides 40, 42, 44, and 46 function as support for the side walls 30 and 32 and also function to maintain the scrap metal, such as the body of an automotive vehicle in a certain position so that it can, readily, be sheared and then compressed.

In FIG. 4, it is seen that the general configuration of the upright guides 40, 42, 44, and 46 is that of a trapezoid. It would be just as convenient to have the general configuration of that of a rectangle but from a saving of material the configuration of a trapezoid is satisfactory.

In FIG. 7, it is seen that there are a plurality of lateral braces 50 connecting the first side wall 30 and the bottom support 22 so as to add rigidity and stability to the side walls 30. Further, it is seen that there are a plurality of lateral braces 52 connecting the second side wall 32 and the bottom support 22 so as to add rigidity and stability to the second side wall 32.

Figure 1:
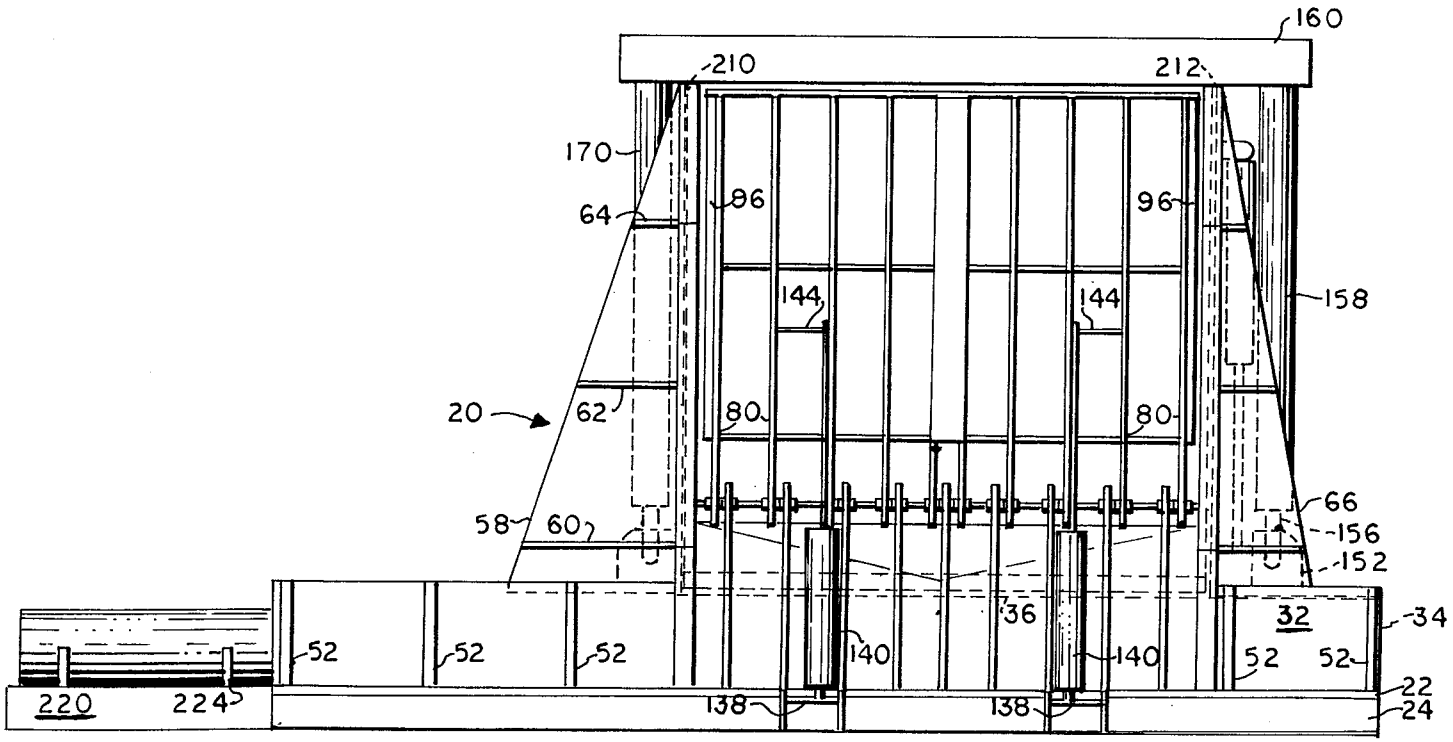
FIG. 1 is a side, elevational view of a specific embodiment of the invention and illlustrates the tunnel in which the scrap metal is compressed, a rotatable side, and means for rotating said rotatable side, means for raising the shear head, means to assist in compressing the scrap metal in the tunnel, and means to control the movement of scrap metal in the tunnel.

In FIG. 1, it is seen that there is a triangular shaped support 58 connecting with the inner part and side of the upright guide 40 and also connecting with the upper surface of the first side wall 32. Similarly, there is such a triangular shaped support connecting with the upright guide 44 and the upper surface of the second side wall 30. There are horizontal reinforcing plates connecting with the outer surface of the triangular guide 58 and with the upright guides 40 or 44. These horizontal reinforcing plates are identified by reference numeral 60, 62, and 64.

Further, in FIG. 1, it is seen that there is a triangular shaped support 66 connecting with the inner part and the outer surface of the upright guide 42 and the upper surface of the first side wall 32. Similarly, there is such a triangular shaped support 67 connecting with the inner part and outer face of the upright guide 46 and with the upper surface of the second side wall 32. And, there are horizontal, lateral supports 68, 70, 72.

The triangular shaped supports 44, 58, 66, 67 add rigidity and stability to the guides on their inner edges.

In FIG. 7, it is seen that there are reinforcing members 74 for the upright guide 40, reinforcing member 76 for the upright guide 42, reinforcing member 78 for the upright guide 44 and reinforcing member 80 for the upright guide 46. The reinforcing members connect with the guides or are integral with the guides and also connect with the legs 24 and feet 26 to add stability.

In FIG. 4, it is seen that there is a first rotatable support 76 positioned near the first side wall 30 and a second rotatable support 78 positioned near the second side wall 32.

The construction of the two rotatable supports 76 and 78 are the same and therefore like reference numerals are used for these two rotatable supports. The rotatable support 76 will be described in detail but it is to be understood that the rotatable support 78 is of the same construction.

In the drawings, it is seen that there are number of support members 80. These support members 80 have a lower edge 82. The lower edge 82 on the inner end of the support member 80 curves around at 84 and turns upwardly into a sloping straight edge 86. Then, the sloping straight edge 86 bends and extends outwardly into a straight edge 88. Then, the edge 88 extends at a right angle into an outer edge 90 which connects with the lower edge 82.

On the upper edges 88, there is positioned a supporting plate 92. Also, on the upper edges 86 there is positioned a supporting plate 94.

On the two outer members 80 and on the outside faces of the members 80, there is positioned a reinforcing plate 96. This reinforcing plate 96 is illustrated in FIGS. 4 and 1. The reinforcing plate 96 may be welded to the two outer members 80 of each rotatable support.

Also, on the outer edges 90 of the members 80, there is an end plate and reinforcing member 98. On the inner end of each of the members 80, there is a passageway and a bearing means 100. There is positioned in the bearing means 100 a shaft 102.

In FIGS. 1, 7–13, there is illustrated the support structure for the rotatable supports 76 and 78.

In FIG. 9, there is illustrated an upright support structure 110 which is welded to the bottom support 22 and to the second side wall 32. It is to be realized that the support structure 110, on the other side of the tunnel 34, is welded to the first side wall 30. The support structure 110 is of a, generally, four-sided configuration having a moderatley upwardy sloping surface 112.

In FIG. 10, there is illustrated an upright support 114 having four sides and with upwardly sloping sides 116. The upright support 114 connects with the second side wall 32 and the bottom support 22. There are two supports 114 connecting with the second supporting wall 32 and there are two supports 114 connecting with the first supporting wall 30.

It is seen that the edge 116 of the support 114 slopes at a more pronounced angle than the edge 112 of the support 110.

In FIG. 11, there is illustrated an upright support 118 having, generally, four sides. The upright support 118 is welded to the second supporting wall 32 and to the bottom support 22. There are two upright supports 118 connecting with the second supporting wall 32, and there are two upright supports 118 connecting with the first supporting wall 30. The upright support 118 has an upwardly inclined edge 120. It is seen that the upwardly sloping edge 120 is at a steeper or greater angle than the edge 116 of the support member 114.

In FIG. 12, there is illustrated an upright support 122 having, generally, four sides. The upright support 122 is welded to the second supporting wall 32 and also to the bottom support 22. It is to be realized that there are two upright supports 122 connecting with the second supporting wall 32 and there are two upright supports 122 connecting with the first supporting wall 30. The upright support 122 has an upwardly inclined edge 124. The upwardly inclined edge 124 is at a steeper angle than the upwardly inclined edge 120 of the upright support 118.

There is an upright support 126 having, generally, four sides. The upright support 126 connects with the second supporting wall 32 and the bottom support 22. There is one upright support 126 connecting with the second supporting wall 32 and there is one upright support 126 connecting with the first supporting wall 30. The upright support 126 has an upwardly inclined edge 128.

In FIGS. 9-13, it is seen that the central upright support 126 has an inclined edge 128 greater than the inclined edges of the outer upright support. There is welded to each of these inclined edges of the upright support, a plate of metal 130. In FIG. 7, it is seen that there are two plates 130, of a, generally, triangular configuration. These two plates 130 are welded to the upper edge of the second supporting wall 32 and also on the inclined edges of the upright support 110, 114, 118, 122, and 126. Likewise, there are two triangular shaped plates 130 which are welded to the upper edge of the first supporting wall 30 and to the inclined edges of the upright supports 110, 114, 118, 122, and 126.

In each of the upright supports 110, 114, 118, 122, and 126, there is a passageway and a bearing means 132. In the bearing means 132, there is positioned the shaft 102.

In FIG. 7, it is seen that on that side of the tunnel having first side wall 30 and attached to the leg 24 and the foot 26, there are two sets 134 of upright supports 136. Likewise, on that side of the tunnel on which there is the second supporting wall 32, there are two sets 134 of upright supports 136. The upright supports 136 in a set 134 are spaced apart and on the same side of the tunnel the two sets 134 are spaced apart. In FIGS. 1 and 4, it is seen that there is a shaft 138 journaled in each set 134 of spaced apart upright supports 136.

A fluid actuated cylinder 140 connects with the shaft 138. The fluid actuated cylinder 140 has a ram 142. The ram 142 connects with the shaft 144. The shaft 144 is journaled between two adjacent praying members or support members 80.

In FIG. 4, it is seen that all of the rams 142 are retracted into the cylinder 140 and that the first rotatable support 76 and that the second rotatable support 78 are, substantially, horizontal on their upper surfaces or in a lowered position.

In FIG. 5, it is seen that the two rams connecting with the second rotatable support 78 are extended so that the second rotatable support 78 is, substantially, vertical. Also, the two rams associated with the first rotatable support 76 are retracted and that the upper surface of the first rotatable support 76 is, substantially, horizontal.

In FIG. 6, it is seen that all of the rams 142 are extended so that the first rotatable support 76 and second rotatable support 78 are, substantially, vertical.

In the drawings, it is seen that the first rotatable support 76 and second rotatable support 78 rotate around their respective shafts 102.

In FIGS. 1 and 2, it is seen that on the outlet end of the tunnel 34 there is welded a horizontal, crosswise support member 150. The support member 150 may be welded on top of the liners or scuffing plates 36 and 38 so that these plates 36 and 38 can function as vertical supports for the support member 150. Further, the support member 150 does not extend all the way from the end of the first supporting wall 30 and second supporting wall 32 to the upright guides 42 and 46. As is seen in FIG. 1, there is a gap so as to allow a stop, which will be later described, to function. In FIGS. 1 and 2, it is seen that there is positioned on top of the support member 150 two spaced apart and outwardly directed supports 152. The two supports 152 may be considered to be a trunnion. There is journaled in the two supports 152 a shaft 154. A ram 156 connects with the shaft 154 and also connects with the fluid actuated cylinder 158. As is seen in FIGS. 1 and 2, the fluid actuated cylinder 158 is directed upwardly and connects with a cross head 160.

With respect to the inlet end of the tunnel 34, see FIGS. 1 and 3, there is a horizontal, crosswise support member 162. This member is welded between the first supporting side wall 30 and the second supporting side wall 32 and to the upright guides 40 and 44. There is positioned on the upper surface of said support member 162, two spaced apart supports 164. The supports 164 may be considered to be a trunnion. A shaft 166 is journaled in said support 164. A ram 168 connects with the shaft 166 and also connects with the fluid actuated cylinder 170. The fluid actuated cylinder 170 connects with the cross head 160.

In FIGS. 14 and 15, it is seen that the cross head 160 is of a general hollow construction having a top plate 174 and a bottom plate 176 and side walls 178 and 180. In FIG. 15, a lateral cross-sectional view, it is seen that the configuration of the cross head 160 is that of a rectangle. In FIG. 14, it is seen that there are a number of lateral cross braces 182 and end caps or end braces 184.

The cross head 160 supports the shear head 190. The shear head 190 is of a hollow construction and comprises side plates 192 and 194 and end walls 196 and 198. There are vertical lateral braces 200 running between the side plates 192 and 194. Further, there is a bottom wall or a bottom support 202.

The bottom edges of side plates 192 and 194 do not extend down to the lowest part of the shear head 190 but instead there is positioned on each side of the shear head 190 a cutting blade 206. The cutting blade may be a special metal having desirable metallurgical properties for shearing and cutting scrap metal. The cutting blade may be attached to the shear head 190 by welding or by counter-sunk bolts 208 and the like.

In FIG. 1, there is shown in phantom line an end plate 210 running between the upright guides 40 and 44 and which end plate 210 may be welded to these upright guides 40 and 44. Also, in FIG. 1, there is illustrated an end plate 212 running between the upright guides 42 and 46 and which end plate 212 may be welded to the upright guides 42 and 46.

In FIG. 16, a fragmentary plan view, it is seen that the members 210 and 212 and that the upright guides 40, 42, 44 and 46 act as guides for the vertical movement or the up-and-down movement of the shear head 190.

In FIG. 1 it is seen that when the shear head 190 is in the lowered position, then the cutting edge 206 is positioned slightly above the top of the scuffing plates or reinforcing plates 36. With the bottom of the shear head 190 in this position, the scrap metal is compressed below the support members 150 and 162, so that the compressed scrap metal can be moved past the support member 150 and out of the exit end of the tunnel 34.

The cross head 160 and the shear head 190 can be elevated so as to be out of the way for the introduction of scrap metal into the apparatus. Then, in order to shear and separate the scrap metal, the shear head can be lowered by introducing fluid under pressure into the cylinders 170 and 158 so as to force the shear head downward to contact the scrap metal and to shear and compress the scrap metal.

In FIGS. 1 and 7–13, it is seen that the shearing area in the apparatus, exclusive of the shear head, is at an angle. As previously stated, the supports 110, 114, 118, 122 and 126 have upwardly inclined edges at different angles. By placing the triangular shaped material 130 on these upwardly inclined edges, and also due to the height of the inward edge of these upright supports and also the height of the first supporting wall 30 or the second supporting wall 32 varying, it is seen that there is formed a generally V-configuration. The edge of the junction of the triangular shaped pieces 130 and the upper part of the first supporting side 30 or the second supporting side 32 defines an anvil. The anvil may be considered to be 216. The cutting edge 206 on the shear head, on each side of the shear head, will contact the inclined anvil 216 at various times. This means that the full force of shearing is not at the same time but is over a brief time period so as to have a requirement for less pressure on the scrap metal and therefore a more positive shearing of the scrap metal.

There is a means for forcing the scrap metal out of the tunnel 34.

In FIG. 1 it is seen that on the left of the apparatus there is a supporting platform 220. There is mounted on the supporting platform 220 a fluid actuated cylinder 222. The fluid actuated cylinder 222 may be connected to the platform 220 by means of brackets 224.

The cylinder 222 has an integral ram 226. The ram 226 connects with a head 228. The head 228 is of, in a lateral cross-sectional view, a generally, rectangular configuration and is of such a dimension as to fit into the tunnel 34 so as to fit above the bottom support 22, in between the first supporting side wall 30 and the second supporting side wall 32 and underneath the lowest position of the shear head 190. As is, readily, appreciated after the scrap metal has been compressed in the tunnel 34 the ram 226 and the head 228 can be moved into the tunnel so as to move the scrap metal out of the exit end of the tunnel so that more scrap metal can be placed into the tunnel.

There is a barrier or a stop on the outlet end of the apparatus 20 or the outlet end of the tunnel 34. In FIGS. 7 and 8, it is seen that in the bottom support 22 there is a slot 230 and in the scuffing plates or reinforcing plates 36 and 38 there is a gap or discontinuity 232. The scuffing plates and this discontinuity define a bracing edge 234.

In FIG. 2 it is seen that there is positioned above the slot 230 and the gap 232 guides 236. There is a vertical door or stop 238 for sliding in the guides 236 and in the gap 234 and into the slot 230.

In FIG. 2 it is seen that on the member 212 there is positioned a fluid actuated cylinder 240. On the member 212 there is a mounting bracket 242 and which mounting bracket connects with the member 212 and also the fluid actuated cylinder 240. The fluid actuated cylinder 240 has a ram 244. There is positioned on the door 238 a mounting bracket 246. The ram 244 connects with the mounting bracket 246. It is possible to lower the door 238 into the slot 230 and into the gap 232. Then, the ram 226 and the head 228 can be moved in the tunnel 34 so as to force the scrap metal into tunnel 234 against the door 238 and to compress the scrap metal. After the scrap metal has been compressed, the door 238 can be raised out of the tunnel and the ram 226 and the head 228 moved into the tunnel so as to move the scrap metal out of the tunnel.

In FIG. 18 there is illustrated a fluid actuated system for moving the rams and the like. For example, there may be a reservoir 250 for hydraulic fluid. There is a motor and pump combination 252 connecting with the reservoir 250 by means of a line 254.

As is recalled, the first rotatable support is moved by fluid actuated cylinders 140 and the ram 142. A line 256 connects the motor and pump combination 252 with a valve 258. The valve 258 connects with one of these cylinders 140 by means of a line 260 and with the other cylinder by means of a line 262. There is a return line 264 from these two cylinders 140 and which return line 264 is connected with the reservoir 250. The cylinders and rams can be activated by adjusting the valve 258 so as to force the fluid under pressure to the cylinders and these cylinders can be de-activated by adjusting the valve 258 to allow the fluid to return from the cylinders to the reservoir 250.

In regard to the second rotatable support 78 a line 266 connects with the valve 268 and then the valve 268 connects by means of a line 270 with the two cylinders 140. There is a return line 272 from the two cylinders 140 and which return line connects with the reservoir 250. The cylinders 140 associated with the second rotatable support 78 can be activated by adjusting the valve 268 so as to extend the rams 142 and by adjusting the valve 268 the rams can be retracted and the fluid allowed to flow back to the reservoir 250. The cylinders 158 and 170 can be activated by adjusting the valve 274. A line 276 connects with the valve 274 which in turn connects with the line 276. The line 276 splits into two branches 278 and 280 for connecting with the cylinders 158 and 170. There is a return line 282 from the cylinders 158 and 170. The cylinder 170 connects with the return line 284 which in turn connects with the return line 282 and the cylinder 158 connects with the return line 286 which in turn connects with the return line 282. The return line 282 connects with the reservoir 250. By adjusting the valve 274, it is possible to introduce fluid under pressure to the cylinders 158 and 170 so as to extend the rams 156 and 168. Then, by adjusting the valve 274, it is possible to allow the fluid to return from the cylinders 158 and 170 so as to retrack the rams 156 and 168. In this manner, it is seen that the cross head 160 and the shear head 190 can be raised and lowered so as to allow scrap metal to be positioned underneath the shear head and also for shearing the scrap metal and compressing the scrap metal. The ram 222 is activated by a line 288 which connects with the motor and pump combination 252 and with the valve 290. The valve 290 connects with the inlet side of the cylinder 222 by means of a line 292. There is a return line 294 connecting with the valve 290 and the return line from the valve 290 is line 296 which connects with the reservoir 250. The cylinder 222 and the ram 226 can be manipulated by the valve 290 so as to move the ram 226 and the ram head 228 in the tunnel 34.

As is recalled, the cylinder 240 and the ram 244 activate the door 238 for controlling movement of scrap metal in the tunnel 34. A line 300 connects with the valve 302 which in turn connects with the inlet line 304 to the cylinder 240. There is a return line 306 from the cylinder 240 which connects with the valve 302. There is a return line 308 from the valve 302 which connects with the reservoir 250. The controlling of the valve 302 controls the cylinder 240 and the ram 244 and the movement of the door 238.

There are various ways of operating this apparatus. One way, see FIGS. 4, 5 and 6 is to have the first rotatable support 76 and the second rotatable support in a substantially horizontal position as illustrated in FIG. 4. Then, scrap metal 320 such as the frame of an automotive vehicle can be placed on the support 76 and 78 and over the tunnel 34 with the shear head 190 in a raised position. The shear head can be lowered so as to shear and separate the central portion of the scrap metal or automotive vehicle from the ends of the scrap metal and to compress the scrap metal into sheared, compressed scrap metal 322, in the tunnel, see FIG. 5. This will leave a first end 324 of the scrap metal and a second end 326 of the scrap metal. The second rotatable support 76 can be elevated so as to dump the first end 324 over the tunnel 34. Then, the shear head 190 can be lowered to shear and compress the end 324 to form sheared and compressed scrap metal 328, see FIG. 6. Then, the first rotatable support 76 can be rotated to dump the second end 326 into the tunnel 34 or over the tunnel 34. Then, the shear head 190 can be lowered to shear and compress the second end 326 into the tunnel 34 to form compressed scrap metal.

At appropriate times, the plunger 226 and the head 228 can be moved in the tunnel 34 to compress the scrap metal against the door 238. Then, the door can be raised and the compressed scrap metal pushed out of the tunnel 34.

Another way of operating the apparatus is to place the scrap metal 320 onto the horizontal or open rotatable supports 76 and 78 as illustrated in FIG. 4 so that the scrap metal 320 is supported on these two rotatable supports and also bridges the tunnel 34. Then, the two rotatable supports 76 and 78 can be elevated and rotated toward each other so as to compress the scrap metal 320. Then, the shear head 190 can be lowered so as to shear the central portion of the scrap metal and to force the scrap metal into the tunnel 34 and to compress the scrap metal in the tunnel 34. Then, the shear head 190 can be elevated and the rotatable supports 76 and 78 rotated closer together so as to position more of the scrap metal or the remains of the scrap metal over the tunnel 34. Then, the shear head 190 can be lowered to further force additional scrap metal into the tunnel 34.

A third way of operating this apparatus is to raise one of the rotatable supports, either 76 or 78, in an upward position as illustrated in FIG. 5 and to have the other rotatable support in a horizontal position. The scrap metal can be loaded by means of a forklift or other appropriate means with the inner part of the scrap metal bearing against the vertical rotatable support. The shear head can be lowered so as to shear off some of the scrap metal and to force and compress said sheared scrap metal into the tunnel 34. Then, the shear head can be elevated and the remainder of the scrap metal forced against the vertical rotatable support. The shear head can again be lowered to shear and separate some of the scrap metal and to compress the scrap metal in the tunnel. In place of the forklift for forcing the scrap metal against the vertical or elevated rotatable support, there may be used other means such as a cylinder and a ram. The horizontal rotatable support functions as a support for supporting the scrap metal prior to being sheared by the shear head 190.

It is to be realized that the shear head 190 upon contacting the scrap metal and shearing the scrap metal, substantially, simultaneously, shears the scrap metal and compresses the scrap metal as the shear head is lowered or falls and contacts the scrap metal so as to shear the scrap metal and the sheared scrap metal is forced into the tunnel 34, and with the further lowering of the shear head 190 into the tunnel 34, the scrap metal in the tunnel 34 is compressed. Further, the shear head 190 does not go all of the way down to contact the bottom support 22 in the tunnel 34 but goes below the anvil 216, but not below the head 228 on the ram 226. This allows the shear head 190 to be in its lowered position and resting on the compressed sheared scrap metal and yet allows the head 228 and the ram 226 to move in the tunnel 34 so as to further compress the compressed sheared scrap metal against the door 238. Then, the door 238 can be elevated out of the tunnel and the ram 226 extended so as to move the head 228 under the bottom of the shearing head 190 and out of the tunnel 34.

It is seen that with the lowering of the shear head 190 to contact the scrap metal that the shear head squeezes the scrap metal and forces the scrap metal into the tunnel 34 and then the shear head in passing the sloping anvil 216 shears the scrap metal and further lowers the scrap metal into the tunnel 34 so as to compress the scrap metal. In effect, the shearing and compressing of the scrap metal is, substantially, a simultaneous operation.

In preparing this patent application, the following patents were made known:

United States Patents

| Patent No. | Patentee | Date Issued |
|---|---|---|
| 2,353,221 | Clifton Et Al. | July 11, 1944 |
| 2,590,700 | Hochman | March 25, 1952 |
| 2,932,244 | Moyer | April 12, 1960 |
| 2,984,174 | Jones | May 16, 1961 |
| 3,037,446 | Thompson | June 5, 1962 |
| 3,039,343 | Richards | June 19, 1962 |
| 3,049,274 | Mosley | August 14, 1962 |
| 3,049,988 | Lindemann Et Al. | August 21, 1962 |
| 3,101,044 | Schlidt Et Al. | August 20, 1963 |
| 3,103,163 | Gates | September 10, 1963 |
| 3,126,816 | Thompson | March 31, 1964 |
| 3,126,817 | Thompson | March 31, 1964 |
| 3,141,401 | Lindemann Et Al. | July 21, 1964 |
| 3,157,082 | Thompson | November 17, 1964 |
| 3,170,389 | Parks | February 23, 1965 |
| 3,180,249 | Patros | April 27, 1965 |
| 3,237,554 | Davis, Jr. | March 1, 1966 |
| 3,266,413 | Sharp Et Al. | August 16, 1966 |
| 3,273,493 | Smiltneek | September 20, 1966 |
| 3,320,051 | Lieberman | May 16, 1967 |
| 3,332,342 | Jouhal Et Al. | July 25, 1967 |
| 3,335,967 | Williams | August 15, 1967 |
| 3,356,016 | Eidal | December 5, 1967 |
| 3,518,078 | Chazen | June 30, 1970 |
| 3,545,369 | Tokushima | December 8, 1970 |
| 3,545,690 | Burian Et Al. | December 8, 1970 |
| 3,563,163 | Schoenauer | February 16, 1971 |
| 3,582,001 | Rose | June 1, 1971 |
| 3,603,514 | Williams | September 7, 1971 |
| 3,606,809 | Chazen | September 21, 1971 |
| 3,610,136 | O'Harah | October 5, 1971 |
| 3,610,138 | Galter | October 5, 1971 |
| Re. 27,194 | Flanagan | October 19, 1971 |
| 3,615,084 | Wasinger | October 26, 1971 |
| 3,641,927 | Ballard | February 15, 1972 |
| 3,643,591 | Bragg | February 22, 1972 |
| 3,643,873 | George | February 22, 1972 |
| 3,730,078 | Flanagan | May 1, 1973 |
| 3,752,064 | Suzuki | August 14, 1973 |

It is seen from the foregoing that I have provided a new shear wherein the shear head, substantially, simultaneously shears and compresses the scrap metal and there is provision for further compressing of scrap metal so as to make a useful, compressed high density small volume bale of scrap metal or unit of scrap metal for economical transportation. As previously stated, it is not economical to transport bulky scrap metal articles as the frame or body of an automotive vehicle for any distance. Normally, the bulky automotive vehicle bodies are collected and assembled at a point and then transported to a processing center such as overseas shipment to steel mills or to interior shipment to steel mills. The more dense or compact the scrap metal is the more scrap metal can be transported in unit bodies and the less transportation cost. Because of this we consider that the subject invention is useful and also, because of the double shearing action of the shear head and, substantially, simultaneously shearing and compressing action of the apparatus on scrap metal so as to achieve both the shearing and the compressing actions of the apparatus. Another use, a minor use, is for the use in the making of movies for the cinema or the making of movies for television in a particular type of movie, such as a mystery movie or a murder mystery movie or a crime movie, it is possible to illustrate the victim as being placed in the body of the scraped automobile and then the victim be baled with the scraped automobile body into small compact mass. Again, this is a small and ancillary use for the apparatus, but it can be used in the entertainment industry. Further, I think that this invention is unobvious from the standpoint of shearing edges or cutting edges on a shearing head and substantially, simultaneously shearing and compressing action of the shear head.

In FIGS. 19 and 20 there is illustrated a portable apparatus 20 mounted on a trailer 320. The trailer 320 has a low-boy bed 322 connecting means 324 for connecting the rear wheels and axles 326 to the rear of the trailer. It is seen that the trailer at the rear rises in a step 328 to form a ledge 330. In the front of the trailer 320 there is an opening 332 so that the outlet end of the tunnel 34 can be positioned near this opening.

In FIGS. 19 and 20 it is seen that there is a conveyor 334 leading away from the front of the trailer 320. The conveyor may comprise an endless belt 360 which runs around sprockets 338 and 340.

There is mounted on the ledge 330 a motor 342 or a prime mover 342. As the apparatus 20 and the trailer 320 are ambulatory it is desirable to have a prime mover 342 an independent motor such as a gasoline motor or a diesel motor. However, if a source of electricity is nearby, the motor 342 can be an electrical motor. The motor 342 can connect with a pump and motor combination 252 or the circulation of a fluid for actuating the ram and the fluid actuated cylinders. As illustrated in FIG. 18, there connects with the pump and motor combination 252 a reservoir 250. The lines for operating the rams and cylinders are not illustrated in FIG. 19 as they have been schematically illustrated in FIG. 18.

The ambulatory trailer 320 and associated apparatus 20 are of value because they can be taken to out-of-the-way places. For example, it is possible to go to a dump and when the garbage or refuse is being dumped instead of dumping old refrigerators, coal stoves, old washing machines and old dryers and the like and then burying these old pieces of equipment with dirt and other garbage, it is possible to segregate and isolate these pieces of equipment. As is well known, the handling of old appliances is not profitable as the appliances are bulky and light in weight do not contain a great deal of scrap metal. However, with this apparatus it is possible to move the trailer to a dump and shear and compress the old appliances into small compact blocks or bales 344, see FIG. 19. Then the bales can be ejected from the tunnel 34 of the apparatus 20 and onto a conveyor to be loaded onto a vehicle for hauling compressed scrap metal. The size and location of the dump will determine the volume pressed scrap metal which is hauled away from the dump. Around an urban area there will probably be a considerable volume of compressed old appliances; it is profitable to haul the small high density bales of the old appliances. It may be necessary to let the trailer and apparatus be at the dump for 1 day or maybe 1 week or a reasonable period of time to compress the miscellaneous metal pieces at the dump into small high density bales. Another use for the apparatus is at wrecking yards whereby bulky pieces of metal can be compressed into small high density bales of 344 for ready transportation. A further use of this apparatus is to go to wrecking yards and the like and to break motor blocks. For example, the ram 226 and the head 228 can be moved out of the tunnel 34 and one or more blocks can be placed in the tunnel 34. The door 238 can be lowered to be in the slot 230 and in the gap 232 and then the ram 226 and the head 228 moved into the tunnel to break the motor blocks. This is of considerable value in that the handling of motor blocks is, quite often, uneconomical that it is advantageous to break the motor blocks. Another use for the apparatus 20 and the trailer 320 is compress garbage and the like in the tunnel 34 by lowering the shearing head 190 to compress the garbage that has been placed in the tunnel. Then the ram 226 and the head 228 can be moved to compress the garbage in the tunnel against the door 238. After the garbage has been compressed, the door 238 can be raised and the ram 226 and the head 228 further extended to force the compressed garbage out of the tunnel. In this way garbage can be compressed into high density blocks which can be used for further disposition such as burying in the earth and the like.

From the foregoing and having presented my invention, what I claim is:

1. A method for operating an apparatus for processing scrap metal to compress the scrap metal and to increase the bulk density of said scrap metal, said apparatus comprising:

a. a moveable shear head;
b. a first wall and a second wall and a bottom support connecting said first wall and said second wall;
c. said first wall and said second wall being spaced apart to define a tunnel for receiving said shear head;
d. means to move said shear head with respect to said first wall and said second wall;
e. a first rotatable support juxtapositioned to said first wall;
f. a second rotatable support juxtapositioned to said second wall;

said method comprising:

g. positioning said first rotatable support on one side of said tunnel to support said scrap metal;
h. positioning said second rotatable support on the other side of said tunnel to support said scrap metal;
i. positioning said scrap metal over said tunnel and in a position to be supported by said first rotatable support;
j. moving said shear head toward said tunnel and into said tunnel to shear some of said scrap metal to form sheared scrap metal and to move said sheared scrap metal into said tunnel;
k. moving said shear head out of and away from said tunnel;
l. rotating said first rotatable support to allow said scrap metal to move to be in a position to be forced into said tunnel by said shear head; and,
m. moving said shear head toward said tunnel and into said tunnel to force said scrap metal into said tunnel.

2. A method for operating an apparatus for processing scrap metal to increase the bulk density of said scrap metal, said apparatus comprising:

a. a moveable shear head;
b. a first wall and a second wall and a bottom support connecting said first wall and said second wall;
c. said first wall and said second wall being spaced apart to define a tunnel for receiving said shear head;
d. means to move said shear head with respect to said first wall and said second wall;
e. a first rotatable support juxtapositioned to said first wall;
f. a second rotatable support juxtapositioned to said second wall;

said method comprising:

g. positioning said first rotatable support on one side of said tunnel to support said scrap metal;
h. positioning said second rotatable support on the other side of said tunnel to support said scrap metal;
i. positioning said scrap metal over said tunnel and in a position to be supported by said first rotatable support;
j. rotating said first rotatable support and said second rotatable support toward each to compress and to position said scrap metal over said tunnel; and,
k. moving said shear head toward and into said tunnel to force said scrap metal into said tunnel and to compress said scrap metal in said tunnel.

3. A method for operating an apparatus for processing scrap metal to increase the bulk density of said scrap metal, said apparatus comprising:

a. a moveable shear head;
b. a first wall and a second wall and a bottom support connecting said first wall and said second wall;
c. said first wall and said second wall being spaced apart to define a tunnel for receiving said shear head;
d. means to move said shear head with respect to said first wall and said second wall;
e. a first rotatable support juxtapositioned to said first wall;
f. a second rotatable support juxtapositioned to said second wall;

said method comprising:

g. positioning said first rotatable support on one side of said tunnel to support said scrap metal;
h. positioning said second rotatable support on the other side of said tunnel and in a position to function as a barrier to moving said scrap metal;
i. positioning said scrap metal on said first rotatable support and over said tunnel;
j. moving said shear head toward said tunnel and into said tunnel to shear some of said scrap metal to form sheared scrap metal and to move said sheared scrap metal into said tunnel and to compress said sheared scrap metal;
k. moving said shear head out of and away from said tunnel; and,
l. moving said scrap metal on said first rotating support toward said second rotatable support and over said tunnel.

* * * * *